United States Patent [19]

Schnier

[11] 4,391,323

[45] Jul. 5, 1983

[54] BAFFLE FOR HEATING PIPES

[76] Inventor: Erhard Schnier, Roemerstr. 18, D-7143 Vaihingen/Enz 7 (Württemberg), Fed. Rep. of Germany

[21] Appl. No.: 223,097

[22] Filed: Jan. 7, 1981

[30] Foreign Application Priority Data

Jan. 10, 1980 [DE] Fed. Rep. of Germany ... 8000478[U]

[51] Int. Cl.[3] ..... F28F 1/20; F24D 19/06

[52] U.S. Cl. ..... 165/183; 219/347; 237/79; 350/294; 362/304

[58] Field of Search ..... 237/70, 73, 76, 79; 219/347, 348, 349, 461; 165/183; 362/297, 298, 301, 302, 304; 350/293, 294, 303

[56] References Cited

U.S. PATENT DOCUMENTS

| | | | |
|---|---|---|---|
| 2,917,616 | 12/1959 | Thomson | 219/347 X |
| 2,946,510 | 7/1960 | Galvin | 237/70 |
| 3,098,922 | 7/1963 | Paxton | 219/347 X |
| 3,322,946 | 5/1967 | Cooper | 219/347 X |
| 3,763,348 | 10/1973 | Costello | 219/347 |
| 3,806,232 | 4/1974 | Gray | 350/303 |
| 3,983,039 | 9/1976 | Eastland | 219/347 X |
| 4,318,089 | 3/1982 | Frankel et al. | 350/294 X |

FOREIGN PATENT DOCUMENTS

| | | | |
|---|---|---|---|
| 220968 | 4/1962 | Austria | 350/303 |
| 34912 | 10/1956 | Fed. Rep. of Germany | 219/347 |
| 3000680 | 7/1981 | Fed. Rep. of Germany | 237/79 |
| 688535 | 4/1930 | France | 362/301 |
| 855397 | 5/1940 | France | 219/349 |
| 563095 | 7/1944 | United Kingdom | 219/349 |
| 960455 | 6/1964 | United Kingdom | 219/349 |

*Primary Examiner*—Sheldon J. Richter
*Attorney, Agent, or Firm*—Michael J. Striker

[57] ABSTRACT

A reflector for mounting above a heating pipe is elongated and in transverse direction subdivided in three sections each of which is arcuately curved in the transverse direction. The center of curvature of the middle section coincides with the vertical symmetry plane of the reflector; the center of curvature of the outer flanking sections are laterally offset and vertically downwardly spaced relative to the center of curvature of the middle section.

9 Claims, 1 Drawing Figure

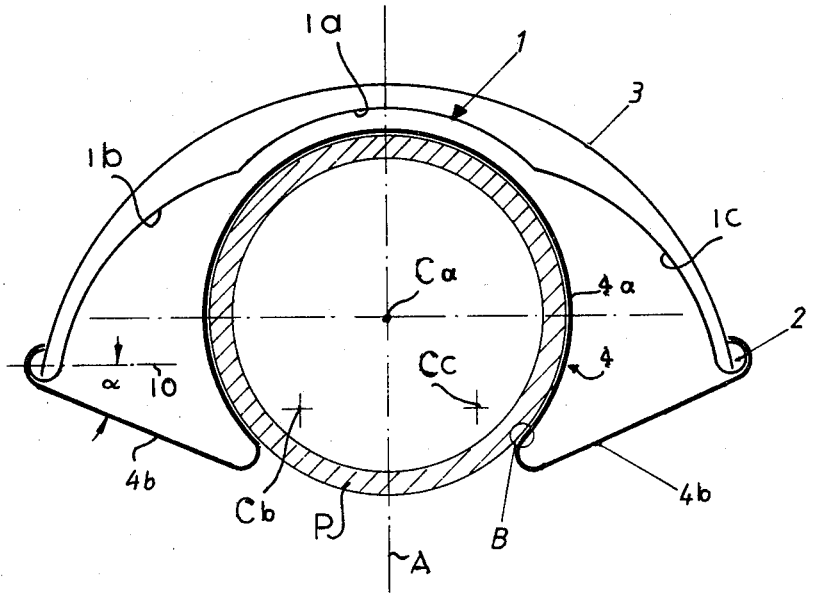
1a
1
3
1b
1c
Cα
4a
2
α
10
Cc
4
4b
Cb
P
B
4b
A

BAFFLE FOR HEATING PIPES

BACKGROUND OF THE INVENTION

The present invention relates to an arcuately curved radiation shield or reflector (i.e., baffle) for heating tubes in spaces which are heated from above, for example greenhouses, factory buildings, storage sheds and the like.

Reflectors of this general type are already known. They consist e.g., of thin, bare rolled aluminum sheet which is so mounted above the heating pipes that due to its elastic deformability it assumes a slightly curved shape. To provide an adequate reflecting effect, these known reflectors must be relatively wide. If they are used in enclosed spaces which are lighted from above, e.g. a greenhouse or assembly building with glass roof for admission of daylight, they will therefore self-evidently have a disadvantageous influence on the incoming light.

SUMMARY OF THE INVENTION

It is an object of the invention to provide an improvement in such reflectors.

A more particular object is to provide an improved reflector of the type in question which is so shaped that it will interfere substantially less with light entering a structure from above the reflector.

Another object is to provide such an improved reflector which will nevertheless, assure optimum reflection of the heat radiated from the heating pipe.

These and other objects of the invention, still to become apparent hereafter, one achieved in accordance with the invention by giving the baffle (i.e., radiator or shield) a cross-sectional configuration composed of several, preferably three, arcuate sections. The center of curvature of the middle (upper) one of the sections is located on the vertical axis of symmetry of the baffle and the center of curvature of the sections flanking the middle section are offset laterally outwardly by identical distances relative to the vertical axis of symmetry of the middle section, and are also offset downwardly by identical distances relative to the center of curvature of the center section and in direction parallel to the symmetry axis of the same.

In this manner the reflector can have a lesser overall width; yet, thanks to the downwardly extending skirt-like lateral portions no reduction is experienced in the amount of heat reflected. To stiffen the sheet metal of the reflector and facilitate its mounting on the holding devices, the two outer longitudinally extending edge portions are formed to produce two outwardly directed hollow not completely closed beads. In known manner these may be used to serve as a support for a metal sheet arranged above the reflector and tending to be arcuately deformed due to its elastic characteristics. Such a metal sheet may, but need not be, present to protect against the development of a convection flow above the reflector.

Because of the special shape of the side walls of the reflector, the same extends rather far downwardly with its side walls compared to the known constructions, but at least to below the center axis of the heating tube. This fact permits a particularly simple and advantageous manner of mounting the reflector. The mounting devices consist of a length of spring steel having a center part which is circularly formed and springily embraces about three quarters of the heating pipe circumference.

The two end parts of the mounting are angled off outwardly, for example for the thus formed arms to be inclined upwardly and to include with a straight line connecting the center of the lateral bends an angle of between about 10° and 50°. The ends of these arms embrace the lateral beads with hook-like shapes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a cross-section through a reflector embodying the invention.

DESCRIPTION OF PREFERRED EMBODIMENTS

The FIGURE shows a heating pipe P, such as extends across the upper area of halls or other large spaces which are heated from above. Of course, there is usually a plurality of such pipes P provided, but for an explanation of the invention the showing of a single pipe will suffice.

Cooperating with the pipe P is a reflector 1 embodying the invention. In cross-sectional profile the reflector 1 is composed—at least at its inner, reflecting surface—of three concave sections 1*a*, 1*b* and 1*c* which extend lengthwise of the reflector (i.e., along the pipe P) and are arcuately curved in transverse direction, as shown.

The center of curvature Ca of the middle section 1*a* is located on the vertical axis of symmetry A of the reflector 1 and coincides in this embodiment with the center of the pipe cross-section, which center in turn in this embodiment is intersected by the axis A. The center of curvature of the sections 1*b* and 1*c* are designated Cb and Cc, respectively, and are offset both laterally and vertically from the center Ca, as shown.

The reflector 1 is made of suitable sheet metal such as is known from the art, for example aluminum. Along the lateral edges of the reflector the sheet metal is shaped to form longitudinally extending beads or bulges 2 which are not completely closed in cross-section. Above the reflector 1 there is arranged an arcuately curved member 3 of sheet metal, the longitudinal edges of which are received in these bulges 2 so that the member 2 is maintained in position (and in its arcuately curved shape) due to this retention of its edges and without requiring any additional structure for the purpose.

The reflector 1 and the member 3 are supported on the pipe P by a supporting structure 4 of elastically yieldable sheet material (e.g., spring steel, synthetic plastic material which is sufficiently heat resistant) having an arcuately curved central clamping portion 4*a* and two arms 4*b* which are so angled as to extend upwardly in the illustrated manner and to define with a straight line 10 connecting the centers of the two bulges 2, respective angles $\alpha$ between about 10° and about 50°.

The central clamping portion 4*a* embraces about three quarters of the circumference of pipe P and the spring force of the material of structure 4 is advantageously selected to be relatively low. This allows the structure 4 to be readily accommodated to different pipe diameters as the portion 4*a* is pushed over the respective pipe—and has the concomitant advantage that only a few different sizes of the structure 4 need be kept in stock, rather than large numbers of different sizes. The elastic forces of the sheet materials of reflector 1 and member 3, acting via the lever arms 4*b*, cause the structure 4 to exert its primary pressure in pipe P in the areas where the arms 4–6 merge into portion 4*a*, i.e., at B; this assures a particularly reliable seating of the structure 4 on pipe P—and hence reliable retention of the reflector in its chosen position. The outer edges of the arms 4*b* are arcuately shaped so as to form open hook-like grooves or channels in which the beads 2 can be lodged, to thereby secure the reflector to the structure 4. There may, of course, be more than one such structure 4 provided per reflector, depending upon how long (in axial direction) the structures 4 are made.

It will be understood that each of the elements described above, or two or more together, may also find a useful application in other types of constructions differing from the types described above.

While the invention has been illustrated and described as embodied in a reflector for heating pipes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A reflector, particularly for mounting above a heating pipe to reflect heat radiated upwardly by the pipe, comprising an elongated sheet-material reflector body having at least three parallel longitudinally extending concave sections each of which is arcuately curved in transverse direction; each of said arcuately curved sections having a center of curvature, the center of curvature of a center one of said sections being located in a vertical longitudinal plane of symmetry of said reflector body; and the centers of curvature of the sections which flank said center section being laterally spaced from said vertical plane in mutually opposite direction and being spaced from the center of curvature of said center section in a direction away from the center section.

2. A reflector as defined in claim 1, wherein said centers of curvature of the flanking sections are spaced from said vertical plane by identical distances and are also spaced from said center of curvature of said center section by identical distances.

3. A reflector as defined in claim 1, said sheet material of said body having longitudinally extending edge portions which are shaped to form hollow, tubular circumferentially incomplete beads.

4. A reflector as defined in claim 3; further comprising an arcuate sheet material member above said reflector body and having longitudinal edges which extend into and are retained in, said beads.

5. A reflector as defined in claim 3; further comprising mounting means for mounting said reflector body on a pipe.

6. A reflector particularly for mounting above a heating pipe to reflect heat radiated upwardly by the pipe, comprising an elongated sheet-material reflector body having at least three parallel longitudinally extending sections each of which is arcuately curved in transverse direction; each of said arcuately curved sections having a center of curvature, the center of curvature of a center one of said sections being located in a vertical longitudinal plane of symmetry of said reflector body; the centers of curvature of the sections which flank said center section being laterally spaced from said vertical plane in mutually opposite direction and being spaced from the center of curvature of said center section in a direction away from the center section; said sheet material of said body having longitudinally extending edge portions which are shaped to form hollow, tubular circumferentially incomplete beads; mounting means for mounting said reflector body on a pipe, said mounting means comprising a mounting structure of elastically yieldable sheet material having a part-circular center clamping portion adapted to at least partly encircle a pipe, and a pair of arms projecting at an angle from said center portion and inclined upwardly relatively thereto from a lower part thereof.

7. A reflector as defined in claim 6, said sheet material of said mounting structure being spring steel.

8. A reflector as defined in claim 6, said center clamping portion being dimensioned to embrace a pipe over about three-quarters of the pipe circumference.

9. A reflector as defined in claim 6, said arms including an angle of between about 10° and 50° with a straight line connecting the centers of said hollow tubular beads, and said arms having free ends shaped to arcuate form so as to embrace and retain the respective beads.

* * * * *